US011786103B2

(12) United States Patent
Renz et al.

(10) Patent No.: US 11,786,103 B2
(45) Date of Patent: Oct. 17, 2023

(54) HOLDER FOR A DISHWASHER BASKET

(71) Applicant: Miele & Cie. KG, Guetersloh (DE)

(72) Inventors: Eugen Renz, Bielefeld (DE); Thorsten Schuette, Paderborn (DE); Eugen Sgurski, Lage (DE); Henning Krenzien, Hilter (DE); Monika Seifert, Detmold (DE); Lothar Wedeking, Guetersloh (DE); Andreas Haas, Bielefeld (DE); Oliver Fleger, Guetersloh (DE); Tomas Koehler, Oskava (CZ)

(73) Assignee: MIELE & CIE. KG, Guetersloh (DE)

( * ) Notice: Subject to any disclaimer, the term of this patent is extended or adjusted under 35 U.S.C. 154(b) by 0 days.

(21) Appl. No.: 17/848,438

(22) Filed: Jun. 24, 2022

(65) Prior Publication Data

US 2022/0409007 A1 Dec. 29, 2022

(30) Foreign Application Priority Data

Jun. 25, 2021 (DE) ..... 10 2021 116 486.9

(51) Int. Cl.
*A47L 15/50* (2006.01)

(52) U.S. Cl.
CPC ..... *A47L 15/503* (2013.01); *A47L 15/504* (2013.01)

(58) Field of Classification Search
CPC ..... A47L 15/50; A47L 15/501; A47L 15/503; A47L 15/504; A47L 15/505
USPC ..... 211/41.1–41.9
See application file for complete search history.

(56) References Cited

U.S. PATENT DOCUMENTS

| | | | | |
|---|---|---|---|---|
| D516,757 | S | 3/2006 | Hedstrom et al. | |
| 11,419,479 | B2 * | 8/2022 | Kim | A47L 15/503 |
| 2022/0240750 | A1 * | 8/2022 | Held | A47L 15/503 |

FOREIGN PATENT DOCUMENTS

| | | | | |
|---|---|---|---|---|
| CN | 108542331 | A | 9/2018 | |
| DE | 102009002270 | A1 * | 10/2010 | A47L 15/503 |
| DE | 102015112783 | A1 * | 2/2017 | A47L 15/503 |
| DE | 102020117406 | A1 * | 1/2021 | |
| DE | 102019216603 | A1 | 4/2021 | |
| EP | 1683465 | A1 | 7/2006 | |
| EP | 1929928 | A1 * | 6/2008 | A47L 15/503 |
| EP | 2025281 | A1 * | 2/2009 | A47L 15/503 |
| EP | 2377455 | B1 * | 7/2013 | A47L 15/503 |
| EP | 3266362 | A1 * | 1/2018 | A47L 15/503 |
| EP | 3357398 | A1 | 8/2018 | |
| EP | 3357397 | B1 * | 3/2022 | A47L 15/503 |
| IT | 20110930 | A1 | 4/2013 | |
| WO | 2013045543 | A1 | 4/2013 | |
| WO | WO-2014108079 | A1 * | 7/2014 | A47L 15/503 |
| WO | WO-2019179116 | A1 * | 9/2019 | A47L 15/50 |

* cited by examiner

*Primary Examiner* — Patrick D Hawn
(74) *Attorney, Agent, or Firm* — LEYDIG, VOIT & MAYER, LTD.

(57) ABSTRACT

A holder for arrangement on a washing basket of a dishwasher includes: a main body and a folding element which is arranged pivotably thereon, the folding element being transferable from a use position to a non-use position and vice versa. The main body has a recess which is open at an edge thereof to receive tubular washware. The folding element has an outer contour corresponding to an inner contour of the recess and, in the use, position at least partially fills the recess flush with a supporting surface provided by the main body.

20 Claims, 8 Drawing Sheets

HOLDER FOR A DISHWASHER BASKET

CROSS-REFERENCE TO PRIOR APPLICATION

Priority is claimed to German Patent Application No. DE 10 2021 116 486.9, filed on Jun. 25, 2021.

FIELD

The invention relates to a holder for arrangement on a washing basket of a dishwasher.

BACKGROUND

Washing baskets for dishwashers in general and holders arranged in the washing basket in particular are well known per se from the prior art, and therefore specific documentary evidence is not necessary at this point. Therefore, reference is also made only by way of example to EP 1 683 465 A1, which proposes a holder which is arranged pivotably on a washing basket of a dishwasher and in particular is used to receive tubular washware, such as bottles, vases, tall glasses, in particular wheat beer glasses, and/or the like.

Dishwashers have a washing compartment which provides a washing space in a manner known per se. When used as intended, the washing space is used to receive washware to be cleaned. Washing baskets are used for positionally secure accommodation of the washware in the washing space; a lower and an upper washing basket are usually provided, depending on the design of the dishwasher.

A washing basket known from the prior art is typically formed from a wire mesh made of a plastic-coated wire and provides supporting surfaces for receiving washware to be cleaned. Washware receptacles in the form of spikes, loops and/or the like can also be provided.

Furthermore, it is known from the prior art to equip washing baskets with holders, in particular pivotably arranged thereon. Thanks to their pivotability, such holders can be transferred from a use position to a non-use position and vice versa.

Holders of this type are used for the positionally secure positioning of, in particular, washware which, due to its size and/or geometric shape, can be held only insufficiently securely by the spikes or wire loops of a washing basket.

Such a holder is disclosed, for example, by the aforementioned EP 1 683 465 A1, this holder being used in particular for receiving tubular washware, in particular bottles, tall glasses, in particular wheat beer glasses, and other hollow vessels.

However, the holder known from EP 1 683 465 A1 is not without disadvantages. It is considered to be disadvantageous in particular that, owing to its design, the previously known holder cannot also be used flexibly for differently designed washware. When used as intended, this means that the holder must remain unused if correspondingly designed washware is not to be cleaned, and therefore part of the available washing space of the dishwasher remains unused and is thus wasted for other washware.

SUMMARY

In an embodiment, the present invention provides a holder for arrangement on a washing basket of a dishwasher, comprising: a main body and a folding element which is arranged pivotably thereon, the folding element being transferable from a use position to a non-use position and vice versa, wherein the main body has a recess which is open at an edge thereof to receive tubular washware, and wherein the folding element has an outer contour corresponding to an inner contour of the recess and, in the use, position at least partially fills the recess flush with a supporting surface provided by the main body.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
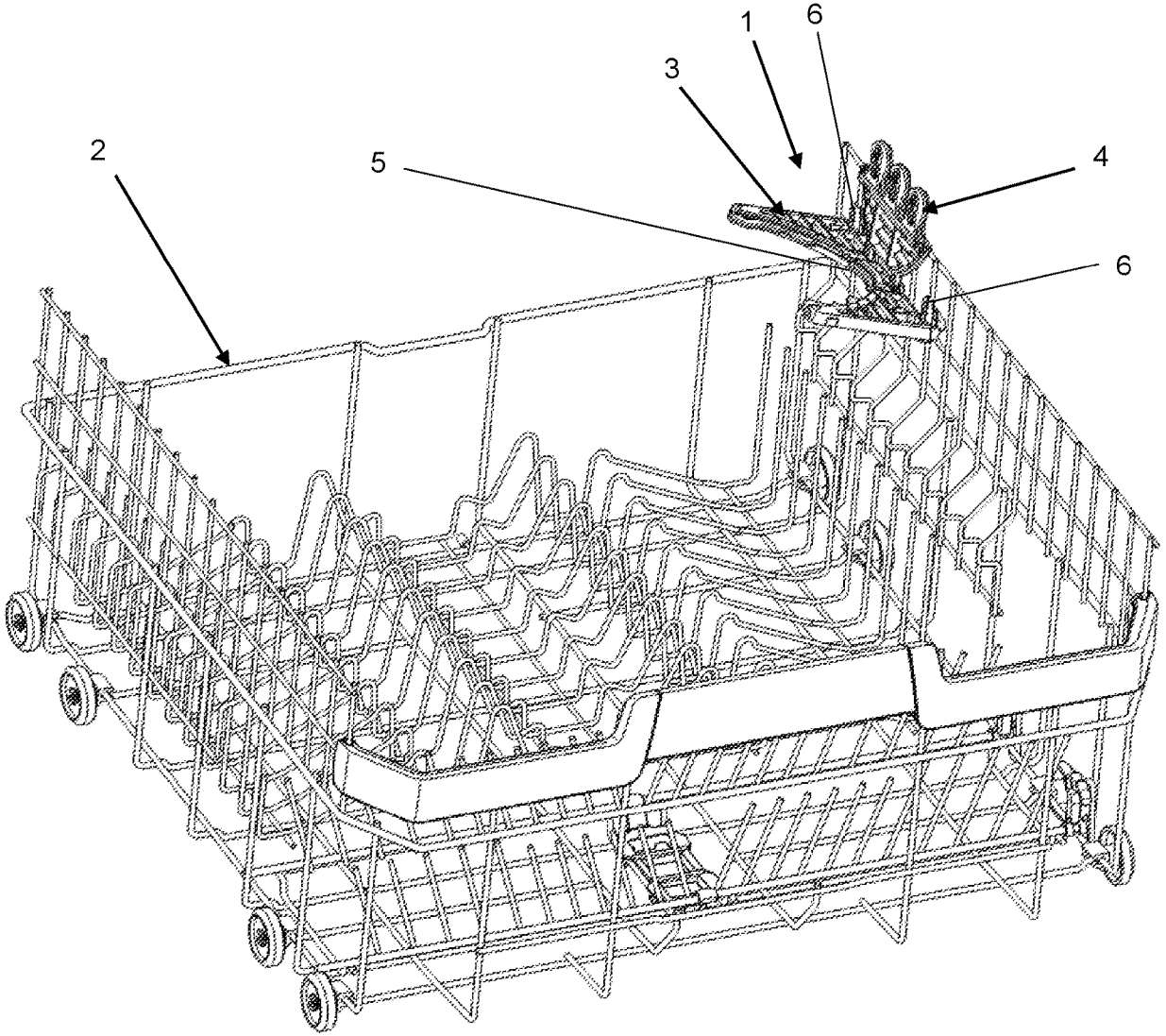
FIG. 1: shows a schematic perspective view of a washing basket with a holder according to the invention in a first position.

In an embodiment, the present invention provides a holder for arrangement on a washing basket of a dishwasher, which holder can be used flexibly as a result of the design and allows differently designed washware to be received equally in a positionally secure manner.

In an embodiment, the present invention provides a holder for arrangement on a washing basket of a dishwasher, having a main body and a folding element which is arranged pivotably thereon and is transferable from a use position to a non-use position and vice versa, wherein the main body has a recess which is open at the edge for receiving tubular washware, wherein the folding element has an outer contour corresponding to the inner contour of the recess and in the use position at least partially fills the recess flush with a supporting surface provided by the main body.

In contrast to the previously known holder according to EP 1 683 465 A1, the holder according to the invention is designed in two parts and has a main body and a folding element. The folding element is arranged pivotably on the main body, which makes it possible to move the folding element in relation to the main body. The folding element can be transferred from a use position to a non-use position and vice versa.

The main body has a recess which is open at the edge for receiving tubular washware. In the context of the invention, such washware is in particular tall vessels or other hollow vessels, such as bottles, vases, wheat beer glasses and/or the like.

The folding element has an outer contour which corresponds to the inner contour of the recess. In this case, the folding element at least partially fills the recess in the use position, specifically flush with a supporting surface provided by the main body.

Due to the pivotable arrangement of the folding element on the main body, the holder according to the invention can be used flexibly. In the folded-up position, the folding element is in its non-use position. In this position, the recess of the main body is opened so that the holder is used for receiving tubular washware. This comes to lie in a positionally secure manner in the recess which is open at the edge, and it is possible to load the recess via the open side.

In the folded-down position, the folding element is in its use position. In this use position of the folding element, the recess is at least partially filled by the folding element. In this case, the folding element terminates flush with a supporting surface provided by the main body. The supporting surface provided by the main body and a supporting surface provided by the folding element thus form in combination a common, flush supporting surface. This supporting surface can be used in particular to receive smaller pieces of crockery, such as cups, or longer cutlery items, such as kitchen tongs or the like.

In the use position of the folding element, the main body and the folding element in combination also form a common peripheral edge which runs in the longitudinal direction of the holder and against which, for example, stems of long-stemmed glasses or the like can be leaned in a positionally secure manner.

As a result, the holder according to the invention can be used flexibly by the user, in contrast to holders known from the prior art. When the folding element is folded up, i.e., when the folding element is in the non-use position, the main body of the holder is used for receiving tubular washware. When the folding element is folded down, i.e., when the folding element is in the use position, the recess of the main body is closed by the folding element, specifically in a flush manner on the top side, so that a common supporting surface is provided by the combination of the main body and the folding element. This supporting surface can be used as a conventional cup receptacle for receiving smaller pieces of crockery or comparatively long cutlery items. In addition, when the folding element is in the use position, the peripheral edge of the holder facing the washing space can be used as a rest for long-stemmed glasses such as wine glasses or champagne flutes. The holder according to the invention thus proves overall to be versatile and flexible to use, which overall allows optimized loading of the washing basket with washware to be cleaned.

According to a further feature of the invention, it is provided for the main body to have two coupling elements for height-adjustable and/or pivotable arrangement on the washing basket.

According to this proposal of the invention, the main body of the holder according to the invention can itself be arranged in a height-adjustable and/or pivotable manner on the washing basket, for which purpose the main body has corresponding coupling elements.

Due to the pivotable arrangement of the main body on the washing basket, the holder according to the invention can assume a total of three different positions. When the main body is folded down, the folding element can be either in the use position or in the non-use position. This allows washware to be received in the manner already described above.

As long as the folding element is in the use position, the main body can be folded up together with the folding element and brought into its non-use position. In this third position of the holder, the washing space which is otherwise occupied by the holder is completely vacated, which allows individual loading of the washing basket by the user. In this third position of the holder, it is therefore possible in particular to load the washing basket with comparatively large items of washware such as pots or bowls. The holder is folded to the side in this position and in this respect does not interfere with the introduction of such comparatively large items of washware into the washing basket.

According to a further feature of the invention, it is provided for the main body to have a central portion and two legs that accommodate the central portion between them.

According to the invention, the main body is designed in a pincer-like manner, wherein a central portion and two legs are provided. The legs accommodate the central portion between them and thus define the recess open on one side provided by the main body. In this case, the recess which is open on one side is accessible via an inlet opening opposite the central portion. This inlet opening is formed at the end between the two end portions of the legs opposite the central portion.

According to a further feature of the invention, the folding element is arranged pivotably on the central portion. A two-joint hinged attachment of the folding element is provided, which allows an overall robust and also torsion-resistant arrangement.

According to a further feature of the invention, it is provided for a coupling element to be arranged on a leg on the washing basket side. One coupling element is therefore provided per leg, so that a total of two coupling elements are provided for the height-adjustable and/or pivotable arrangement of the main body on the washing basket. This also allows a robust and torsion-resistant arrangement.

According to a further feature of the invention, it is provided for the recess to provide a peripheral edge, the contour of which runs along an ellipse.

This type of embodiment provides the advantage that the recess is suitable for being able to receive washing items of different diameters in the same way. In addition, the elliptical or parabolic design of the recess causes an automatic centering of an item of washware which is received as intended by the recess.

The elliptical design also has the advantage that an item of washware arranged as intended in the recess has contact with the recess only at two points. As a result, the contact area between the peripheral edge of the recess and the item of washware is minimized, which helps to reduce washing shadows, as well as undesirable collection regions in which residual washing liquid can accumulate in an undesired manner.

According to a further feature of the invention, it is provided for the legs of the main body to provide contact elements made of a resilient material, preferably silicone, on the recess side. The formation of such contact elements ensures in particular that the washware can be brought to rest against the holder in a protected manner. On the one hand, vibrations occurring during intended use can be cushioned, which promotes a positionally secure hold of the washware, and on the other hand unwanted external damage to the washware can be avoided.

According to a further feature of the invention, it is provided for the contact elements to provide a contact edge for tubular washware, the contact edges each having a corrugated profile. This corrugated design supports the size variability of the washware that can be received by the holder as intended.

According to a further feature of the invention, it is provided for the central portion to provide a support body made of a resilient material, preferably silicone, on the recess side. During intended operation, this support body is not used as a rest for the washware to be cleaned. The support body is solely intended to ensure, in particular if the washing basket is not loaded properly by the user, that washware is not damaged by knocking against the main body, which is formed from a comparatively hard plastic material. In such a case, the support body provides resilient support, so that undesired damage to the washware is avoided.

According to a further feature of the invention, it is provided for the folding element to be locked to the main body in the use position. This locking ensures that, when the main body is pivoted up, the folding element can no longer pivot relative to the main body. The holder is thus securely positioned in its third possible position.

According to a further feature of the invention, it is provided for the folding element to have a peripheral edge which is opposite the central portion of the main body and has two or more recesses arranged one behind the other in the folding element longitudinal direction, each for receiving a stem of a stemmed glass or similar washware, the recesses each being equipped with a clamping part which provides a clamping receptacle, the clamping parts preferably being provided by a clamping strip made of a resilient material, in particular formed in one piece.

The clamping strip and thus also the clamping parts provided by the clamping strip are formed from a resilient material, which, when used as intended, allows the stem of a glass to be received in a shock-absorbing manner. The impacts which arise in particular due a washing basket being pushed back and forth can thus be damped, which proves to be more protective overall for the washware held by the holder. In addition, the resilient properties of the material of the clamping strip mean that a secure accommodation of stemmed glasses received by the holder is ensured, and in this respect, glasses received by the holder are in particular prevented from coming out of the respective recess undesirably. This helps in particular to avoid glass breakage.

The clamping part provided for each recess has two legs. These legs form the clamping receptacle between them. Adjacent legs of adjacent clamping parts are preferably formed in one piece. They preferably form a common tongue part which has a recess. The recess is preferably formed in the center of the tongue part.

The clamping parts, which are preferably formed in one piece as a clamping strip, moreover enable simplified assembly. This is because, during assembly, not all recesses of the holder are equipped with a respective clamping part. A separate mounting of clamping part per recess is thus advantageously avoided.

According to a further feature of the invention, it is provided for the clamping parts of the recesses on the outside in the folding element longitudinal direction to interact with the respectively associated contact elements of the main body. The holder is thus supplemented on the outside of the clamping part by two further recesses together with the clamping body, whereby a holder, the clamping element of which provides multiple, for example n=2 or n>2 recesses, has a total of n+2 recesses, i.e., for example 4 or more recesses together with associated clamping parts.

The invention overall proposes a holder which in particular has the advantages listed below.

A secure and only optionally usable receptacle for hollow vessels is provided.

The receiving contour for hollow vessels is designed in such a way that hollow vessels both with a small diameter and with a larger diameter are always held exclusively at only two contact points, and the distance of the area center of the hollow vessel from the position of the holder position on the receiving contour is always minimal. As a result, hollow vessels of different diameters are always held securely and do not slip during the movement of the washing basket. The contour of the recess used as a receptacle is similar to an ellipse or parabola, which causes automatic centering.

If the folding element is in its folded-down position, i.e., in the use position, other cooking utensils can be received by the holder. In this case, the folding element and the main body form an overall, flush support.

The holder is arranged in a height-adjustable manner on the washing basket, which means that hollow vessels with a large, heavy foot, in particular wheat beer glasses, and only a smaller diameter in the region of the foot, are held securely.

The contour of the rest for hollow vessels is designed such that it consists of a softer material than the material of the main body.

FIG. 1 shows a schematic perspective diagram of a washing basket 2 of a dishwasher otherwise not shown in the figures.

The washing basket 2 is designed in a form known per se and consists of a wire mesh made of a plastic-coated wire. The washing basket 2 is equipped with a holder 1 according to the invention.

The holder 1 is formed in two parts and has a main body 3 and a folding element 4. The folding element 4 is arranged pivotably on the main body 3 and can be transferred from a use position to a non-use position and vice versa. FIG. 1 shows this folding element 4 in the non-use position.

Figure 4:
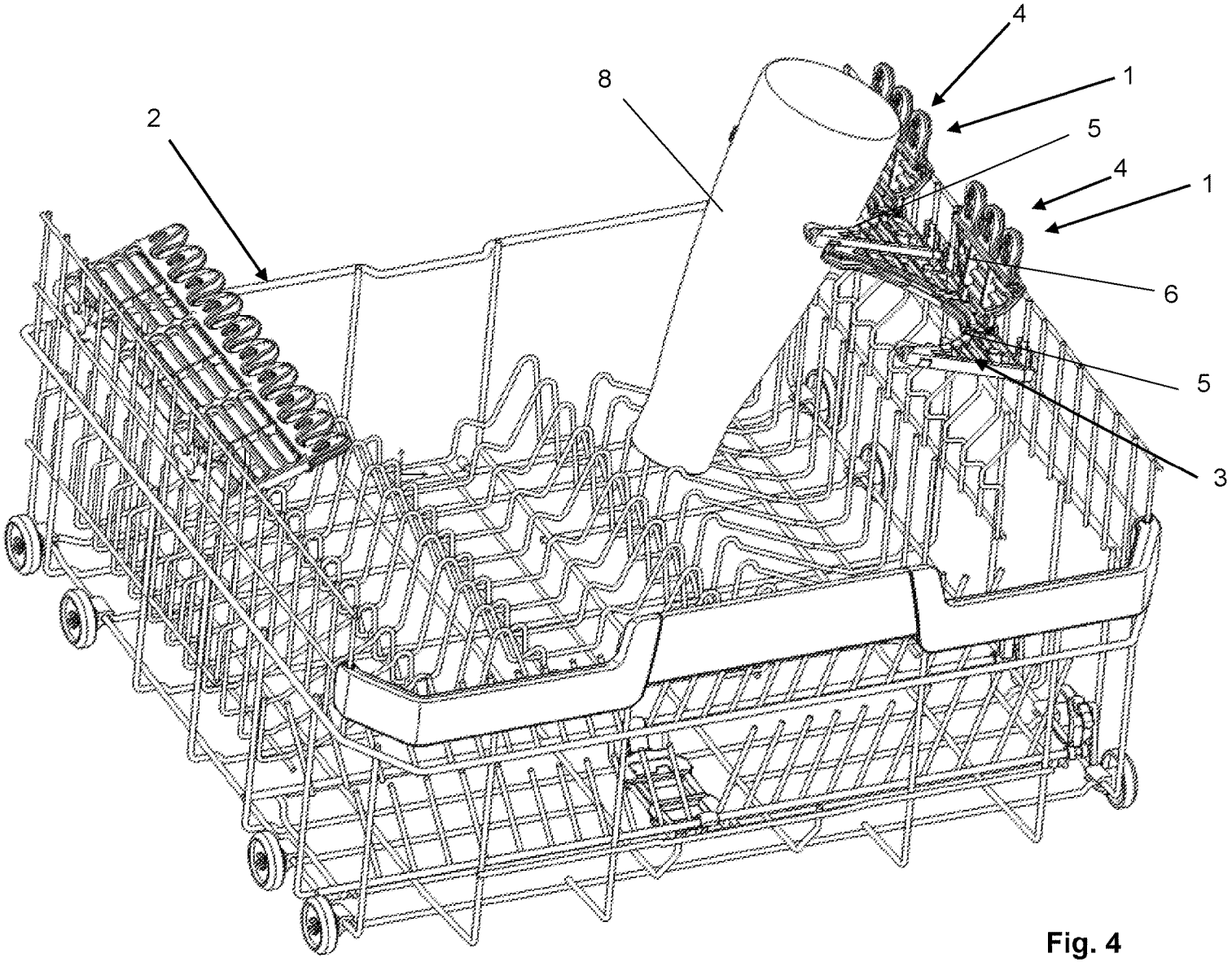
FIG. 4: shows a schematic perspective diagram of a washing basket with an item of washware received by the holder according to the invention.

The main body has a recess 5 which is open at the edge and is used to receive tubular washware 8, as can be seen from the diagram according to FIG. 4.

In the non-use position of the folding element 4 shown in FIG. 1, the receptacle 5 provided by the main body 3 is accessible so that it can be used by the user for receiving tubular washware 8.

Figure 2:
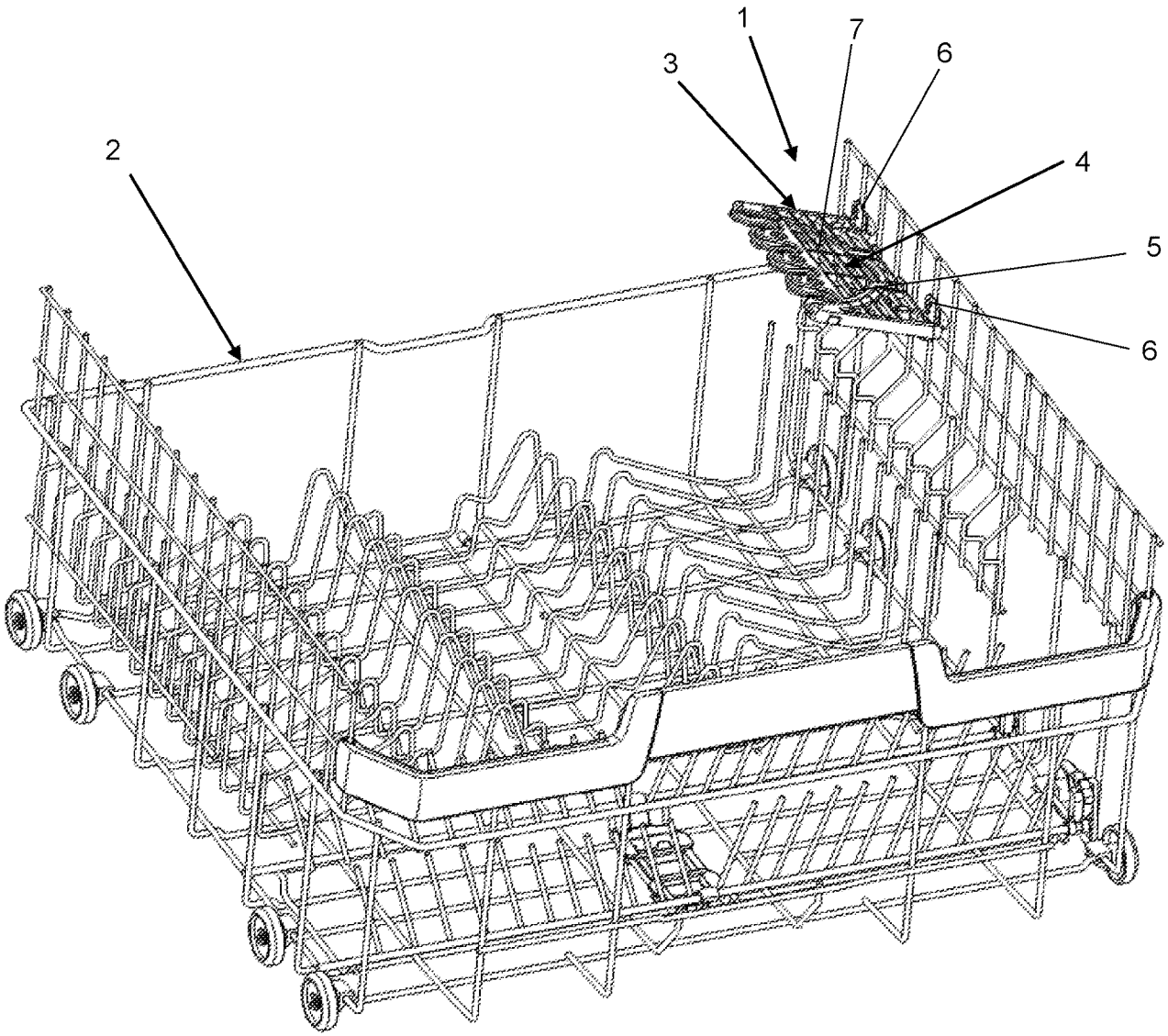
FIG. 2: shows a schematic perspective diagram of a washing basket with a holder according to the invention in a second position.

FIG. 2 shows the holder 1 with the folding element 4 folded down, in which position the folding element 4 is in the use position. As can be seen in conjunction with FIGS. 1 and 2, the folding element 4 has an outer contour 10 which corresponds to the inner contour 9 of the recess 5, so that the folding element 4 at least partially fills the recess 5 in the use position, specifically flush with a supporting surface 11 provided by the main body 3 (cf. FIG. 6).

Figure 8:
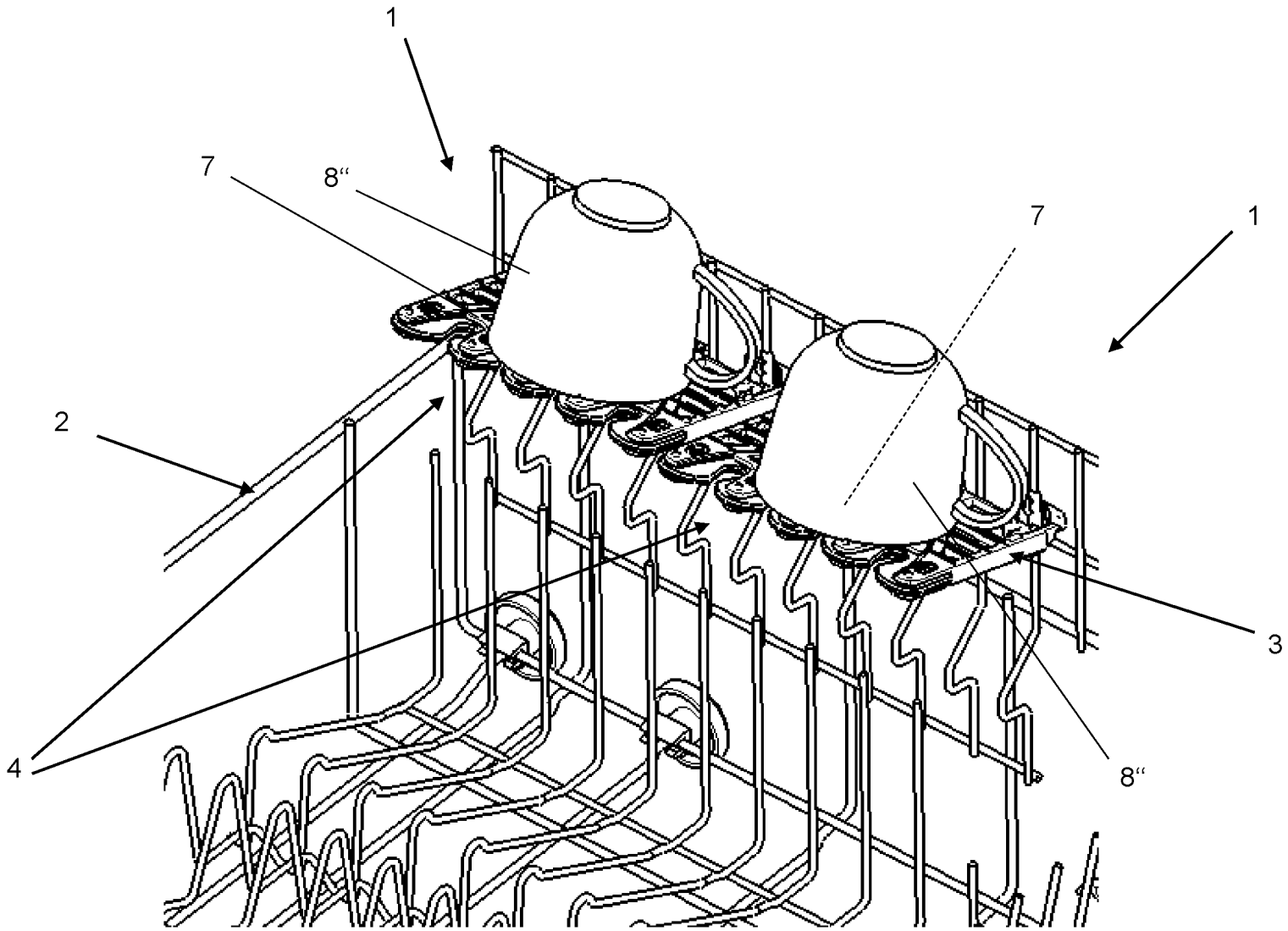
FIG. 8: shows a schematic perspective diagram of a partial view of a washing basket with another further item of washware received by the holder according to the invention

In the use position of the folding element 4, the main body 3 and the folding element 4 thus form in combination a common supporting surface 7, which is used to receive items of crockery or cutlery. In particular, smaller items of crockery, such as cups, are suitable as items of crockery. Such a use for cups as a further items of washware 8" is illustrated, for example, in FIG. 8. With regard to possible items of cutlery, the supporting surface 7 is used in particular to receive comparatively long items of cutlery, in particular those which can be accommodated in a cutlery basket or cutlery drawer only inadequately.

Figure 3:
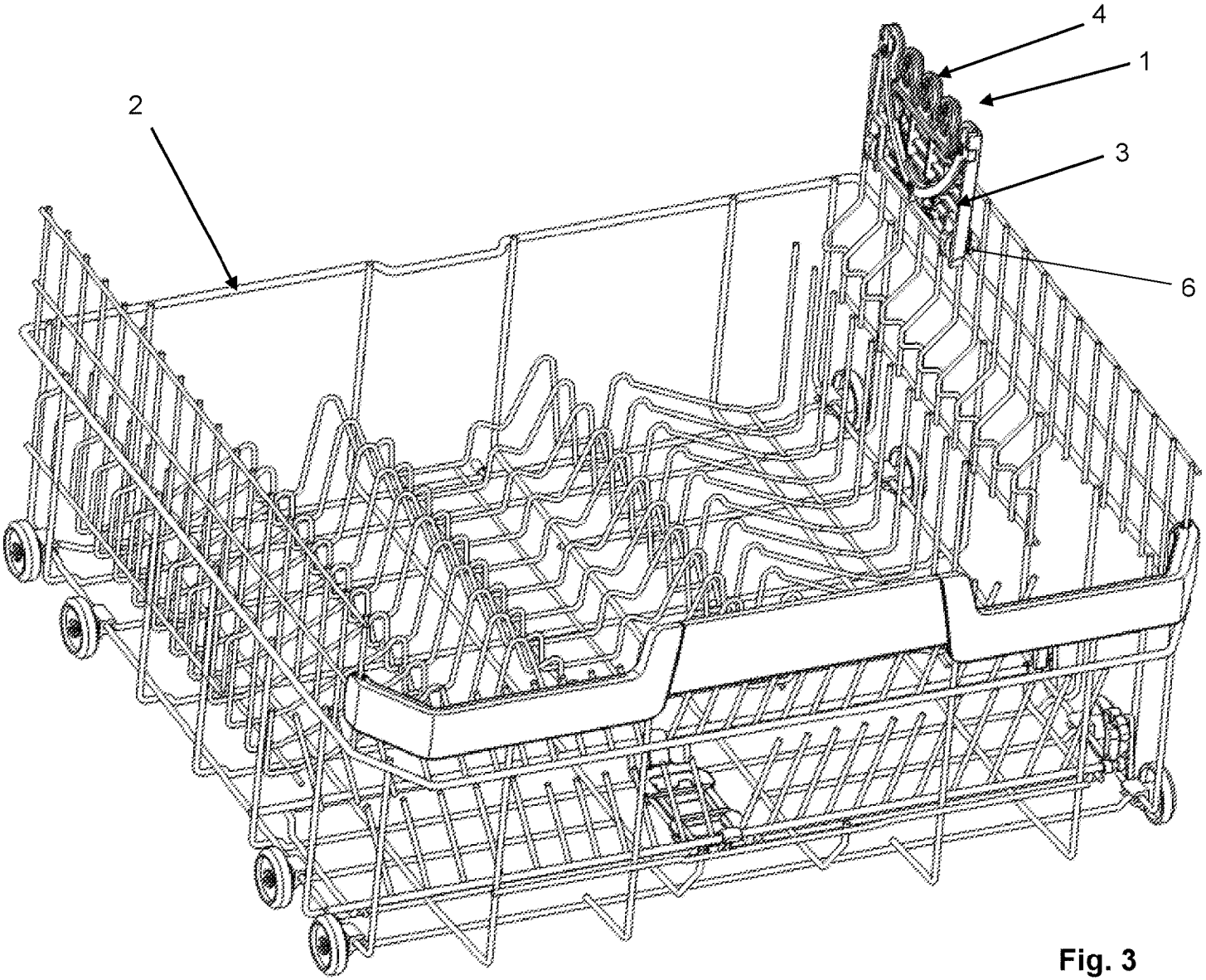
FIG. 3: shows a schematic perspective diagram of a washing basket with a holder according to the invention in a third position.

As can be seen in FIG. 3, the main body 3 is equipped with coupling elements 6 which allow a pivotable arrangement of the main body 3 on the washing basket 2. FIG. 3 shows the folded-up position of the main body 3. In this position of the holder 1, the supporting surface located underneath the holder 1 from the washing basket 2 is freely loadable, so that the washing basket 2 can also be used in the region of the holder 1 for comparatively large washware, such as pots or bowls.

As can be seen by viewing FIGS. 1 to 3 together, the holder 1 according to the invention can assume a total of three positions. In the first position of the holder 1 according to FIG. 1, the holder 1 is used to receive comparatively large hollow vessels, as shown by way of example in FIG. 4. In the position shown in FIG. 2, the holder 1 can in particular be used in that washware is placed on the supporting surface 7 provided by the holder 1. In addition, the peripheral edge of the holder 1 on the washing basket side can be used as a rest for other washware, in particular as a rest for stems of long-stemmed glasses. Finally, the third position is shown in FIG. 3, according to which the holder 1 is moved into its non-use position, so that larger items of washware can also be received by the washware 2 in the region of the holder 1.

FIG. 4 shows that the washing basket 2 can be equipped not only with one holder 1. Rather, multiple holders 1 arranged one behind the other can be provided in the depth direction of the washing basket 2, the exemplary embodiment according to FIG. 4 showing two such holders 1.

Figure 5:
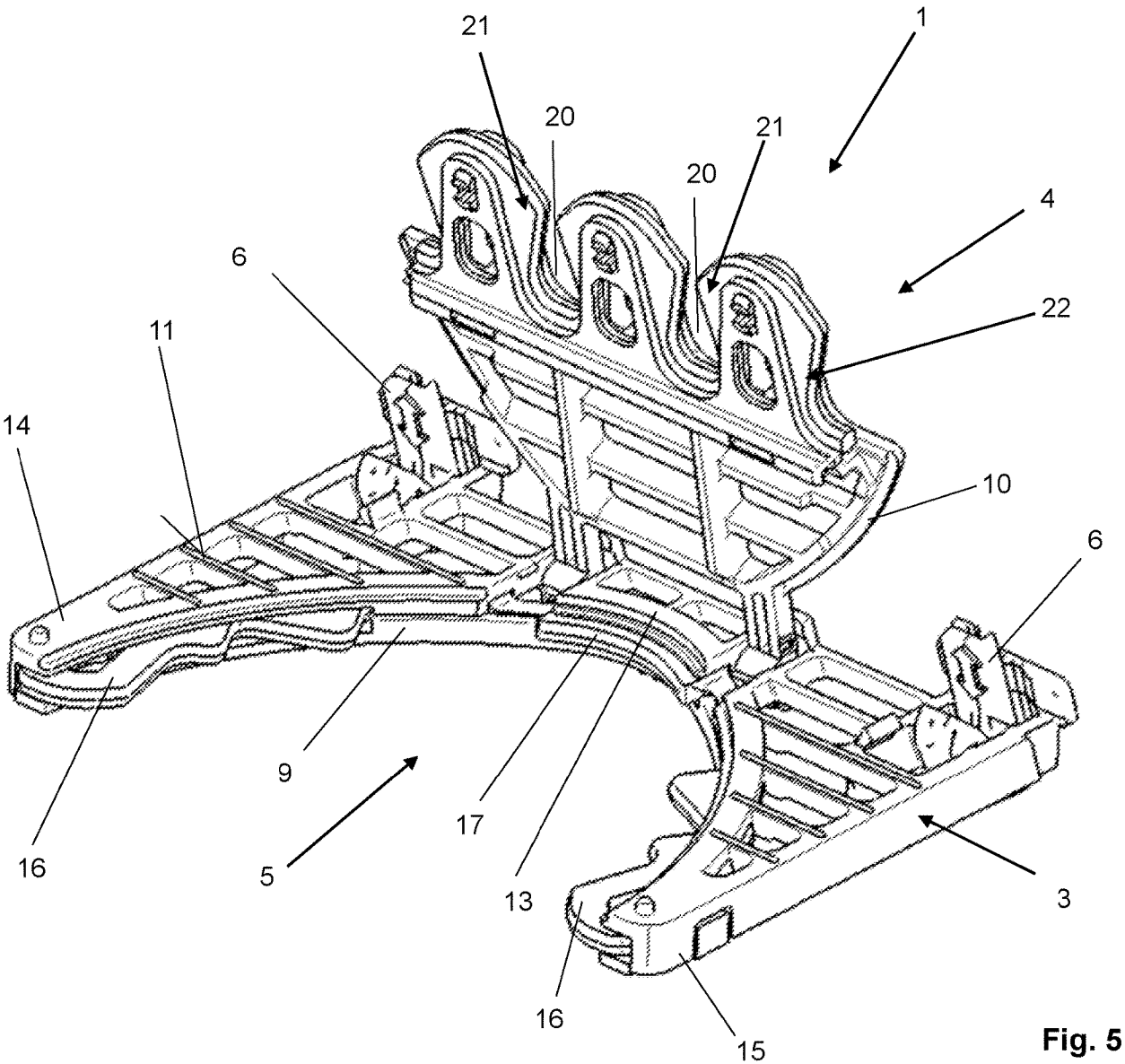
FIG. 5: shows a schematic perspective diagram of a holder according to the invention in a first position.
Figure 6:
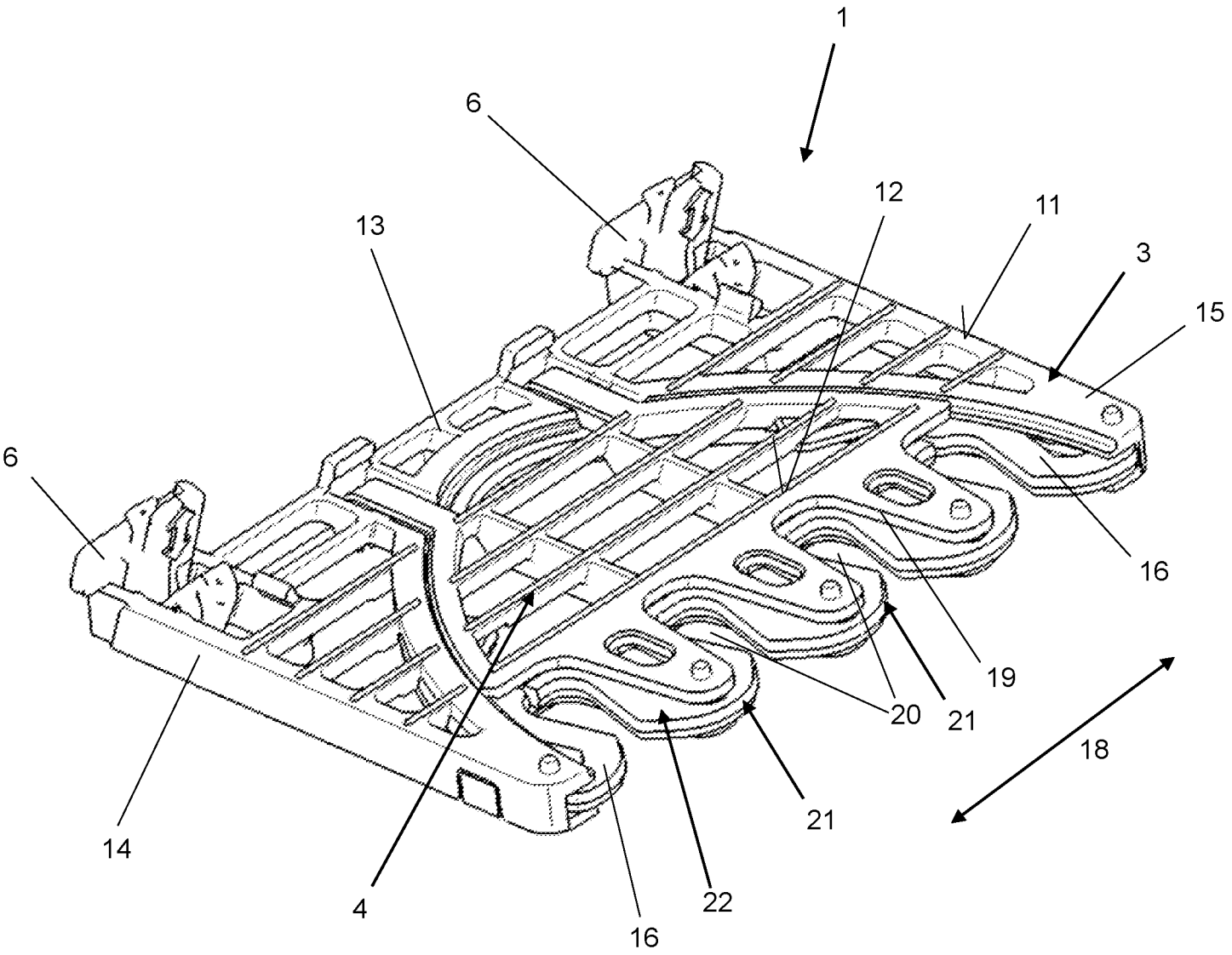
FIG. 6: shows a schematic perspective diagram of a holder according to the invention in a second position.

FIGS. 5 and 6 in combination show the holder 1 according to the invention in detail.

As already explained above, the holder 1 has a main body 3 and a folding element 4 arranged pivotably thereon. The folding element 4 can be transferred from a non-use position according to FIG. 5 into a use position according to FIG. 6 and vice versa.

The main body 3 provides a supporting surface 11, and the folding element 4 provides a supporting surface 12, as is apparent from FIG. 6. When these two supporting surfaces 11 and 12 are combined, an overall available supporting surface 7 is obtained, as already explained above with reference to FIG. 2.

FIG. 5 shows in detail the receptacle 5 provided by the main body 3. This has an inner contour 9, which corresponds to the outer contour 10 of the folding element 4. When used as intended, when the folding element 4 is in the use position, the recess 5 is thus filled at least partially, as can be seen in FIG. 6.

When the folding element 4 is in the non-use position according to FIG. 5, the recess 5 is used for receiving tubular washware.

The main body 3 has a central portion 13 and two legs 14 and 15 which accommodate the central portion 13 between them. In this case, the folding element 4 is arranged pivotably on the central section 13, whereas the two legs 14 and 15 each provide a coupling element 6 for the height-adjustable and/or pivotable arrangement of the holder 1 on the washing basket 2.

The legs 14 and 15 of the main body 3 provide contact elements 16 made of a resilient material on the recess side, the material preferably being silicone. An item of washware received by the recess 5 when used as intended comes to rest against these contact elements 16, which ensures protective support of said washware.

The recess 5 has a contour 9 which has an elliptical profile. As a result, self-centering of washware received is ensured. In addition, the recess 5 is equally suitable for washware of different diameters.

The contact elements 16 are used as a support for the folding element in the use position, as a result of which the above-described flush termination of the two supporting surfaces 11 and 12 is ensured.

The central portion 13 of the main body has a support body 17 likewise formed from a resilient material. When used as intended, this support body 17 is not used as a rest for the washware to be received. Only the contact elements 16 are used for this, whereby a two-point contact of the washware is ensured. The support body 17 is solely intended to ensure that, in the event of incorrect use by the user, washware to be received by the holder 1 does not undesirably knock against the central portion, resulting in damage to the washware.

As can also be seen in FIGS. 5 and 6 in combination, the folding element 4 has a peripheral edge which is opposite the central portion 13 of the main body 3 and has two recesses 19 arranged one behind the other in the folding element longitudinal direction 18. In this case, the recesses 19 are each equipped with a clamping part 21 which provides a clamping receptacle 20. The clamping parts 21 are provided, for example, by a clamping strip 22 formed in one piece from a resilient material.

Figure 7:
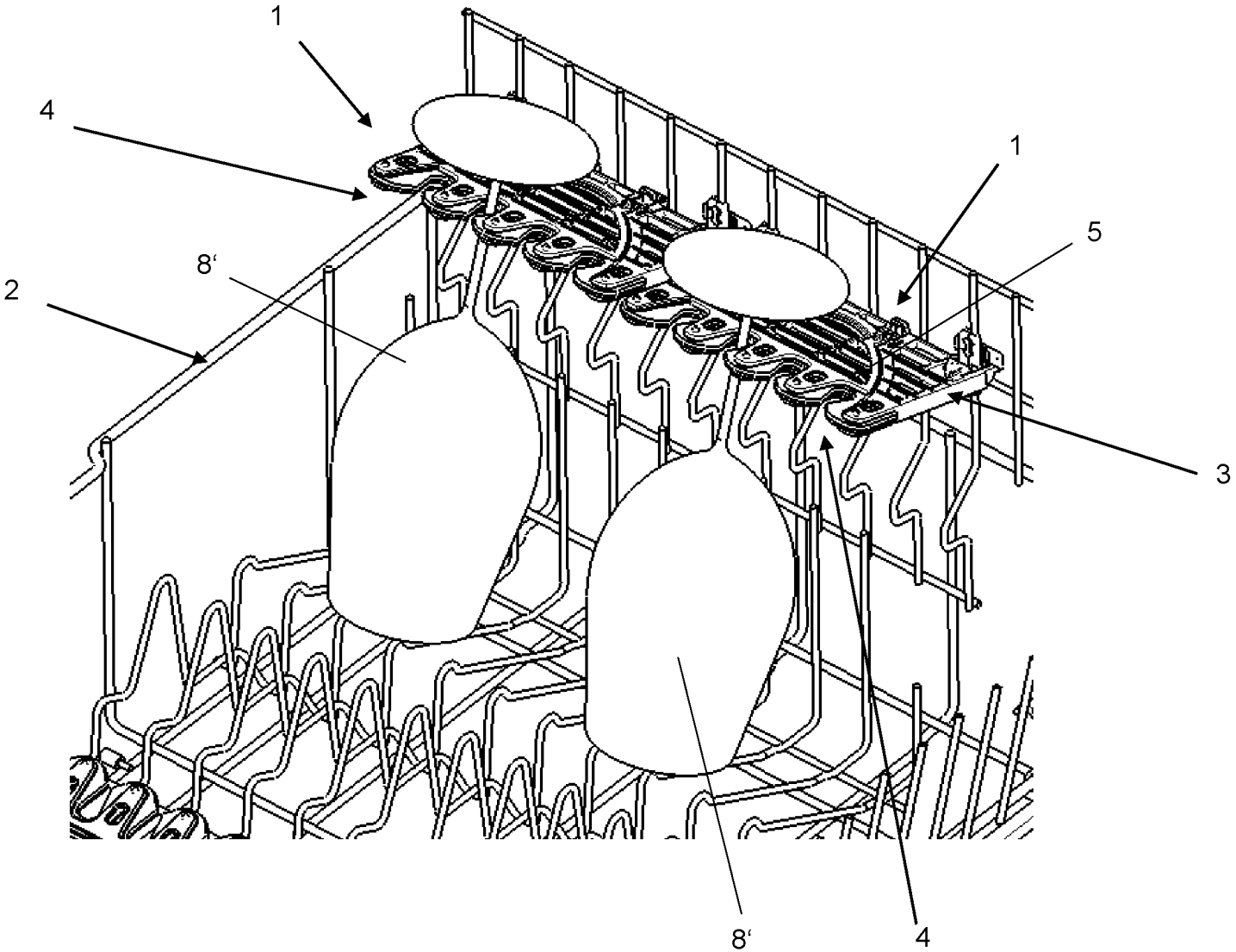
FIG. 7: shows a schematic perspective diagram of a partial view of a washing basket with a further item of washware received by the holder according to the invention.

When the folding element 4 is in the use position, the recesses 19 are used to receive a stem of a stemmed glass or similar washware, the stem being securely received and held by the respective clamping receptacle 20 of the associated recess 19. This is illustrated in FIG. 7, in which two further items of washware 8' in the form of stemmed glasses, for example wine glasses, are shown inserted into the washing basket, their respective stems being held in a clamping receptacle 20 of a folding element 4, as shown enlarged in FIG. 6

As shown in particular in the diagram according to FIG. 6, it is provided for the clamping parts 21 of the recesses 19 on the outside in the folding element longitudinal direction 18 to interact with the respectively associated contact elements 16 of the main body 3. In this way, four recesses 19 per holder 1 are provided in the interaction of the folding element 4 and the main body 3.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE SIGNS

1 Holder
2 Washing basket
3 Main body
4 Folding element
5 Recess
6 Coupling element
7 Supporting surface
8 Item of washware
8' Further item of washware
8" Further item of washware
9 Inner contour
10 Outer contour
11 Supporting surface (main body)
12 Supporting surface (folding element)
13 Central portion
14 Leg
15 Leg
16 Contact element
17 Support body
18 Folding element longitudinal direction
19 Recess
20 Clamping receptacle
21 Clamping part
22 Clamping strip

The invention claimed is:

1. A holder for arrangement on a washing basket of a dishwasher, comprising:
- a main body and a folding element which is arranged pivotably thereon, the folding element being transferable from a use position to a non-use position and vice versa,
- wherein the main body has a recess which is open at an edge thereof to receive tubular washware,
- wherein the folding element has an outer contour corresponding to an inner contour of the recess and, in the use, position at least partially fills the recess flush with a supporting surface provided by the main body, and
- wherein the recess provides a peripheral edge, a contour of which runs along an ellipse.

2. The holder of claim 1, wherein the main body has two coupling elements configured for height-adjustable and/or pivotable arrangement on the washing basket.

3. The holder of claim 1, wherein the main body has a central portion and two legs accommodating the central portion between them.

4. The holder of claim 3, wherein the folding element is arranged pivotably on the central portion.

5. The holder of claim 3, wherein a coupling element is arranged on one leg of the two legs on a washing basket side.

6. The holder of claim 3, wherein the two legs of the main body provide contact elements comprising a resilient material on a recess side.

7. The holder of claim 6, wherein the contact elements provide a contact edge for tubular washware, and
- wherein the contact edge has a corrugated profile.

8. The holder of claim 3, wherein the central portion provides a support comprising a resilient material on a recess side.

9. The holder of claim 1, wherein the folding element is lockable to the main body in the use position.

10. The holder of any claim 3, wherein the folding element has a peripheral edge which is opposite the central portion of the main body and has two recesses arranged one behind another in a folding element longitudinal direction, each of the two recesses being configured to receive a stem of a stemmed glass or similar washware.

11. The holder of claim 10, wherein the two recesses are each equipped with a clamping part which provides a clamping receptacle.

12. The holder of claim 11, wherein the clamping parts of the recesses on an outside in a clamping element longitudinal direction are configured to interact with respectively associated contact elements of the main body.

13. A washing basket for a dishwasher, comprising:
- the holder of claim 1 arranged or arrangeable thereon.

14. The holder of claim 6, wherein the resilient material comprises silicone.

15. The holder of claim 8, wherein the resilient material comprises silicone.

16. The holder of claim 11, wherein the clamping parts comprise a clamping strip formed in one piece from a resilient material.

17. The holder of claim 16, wherein the resilient material comprises silicone.

18. A holder for arrangement on a washing basket of a dishwasher, comprising:
- a main body and a folding element which is arranged pivotably thereon, the folding element being transferable from a use position to a non-use position and vice versa,
- wherein the main body has a recess which is open at an edge thereof to receive tubular washware,
- wherein the folding element has an outer contour corresponding to an inner contour of the recess and, in the use, position at least partially fills the recess flush with a supporting surface provided by the main body,
- wherein the main body has a central portion and two legs accommodating the central portion between them,
- wherein the two legs of the main body provide contact elements comprising a resilient material on a recess side,
- wherein the contact elements provide a contact edge for tubular washware, and
- wherein the contact edge has a corrugated profile.

19. A holder for arrangement on a washing basket of a dishwasher, comprising:
- a main body and a folding element which is arranged pivotably thereon, the folding element being transferable from a use position to a non-use position and vice versa,
- wherein the main body has a recess which is open at an edge thereof to receive tubular washware,
- wherein the folding element has an outer contour corresponding to an inner contour of the recess and, in the use, position at least partially fills the recess flush with a supporting surface provided by the main body,
- wherein the main body has a central portion and two legs accommodating the central portion between them,
- wherein the folding element has a peripheral edge which is opposite the central portion of the main body and has two recesses arranged one behind another in a folding element longitudinal direction, each of the two recesses being configured to receive a stem of a stemmed glass or similar washware,
- wherein the two recesses are each equipped with a clamping part which provides a clamping receptacle, and wherein the clamping parts of the recesses on an outside in a clamping element longitudinal direction are configured to interact with respectively associated contact elements of the main body.

20. A holder for arrangement on a washing basket of a dishwasher, comprising:

a main body and a folding element which is arranged pivotably thereon, the folding element being transferable from a use position to a non-use position and vice versa, wherein the main body has a recess which is open at an edge thereof to receive tubular washware, wherein the folding element has an outer contour corresponding to an inner contour of the recess and, in the use, position at least partially fills the recess flush with a supporting surface provided by the main body, and wherein the recess provides a peripheral edge, a contour of which runs along an ellipse or a parabola.

* * * * *